US005520391A

United States Patent [19]

Howe

[11] Patent Number: 5,520,391

[45] Date of Patent: May 28, 1996

[54] GOLF BACKSWING TRAINING DEVICE

[75] Inventor: Brian C. Howe, 5821 N. Marmora Ave., Chicago, Ill. 60646

[73] Assignee: Brian C. Howe, Chicago, Ill.

[21] Appl. No.: 426,576

[22] Filed: Apr. 21, 1995

[51] Int. Cl.[6] ..... A63B 69/36

[52] U.S. Cl. ..... 473/265; 473/261

[58] Field of Search ..... 273/200 R, 200 B, 273/186.1, 197 A, 207, 208; 434/252

[56] References Cited

U.S. PATENT DOCUMENTS

| | | | |
|---|---|---|---|
| 1,623,119 | 4/1927 | Kearney | 273/207 |
| 1,807,377 | 5/1931 | Brokaw | 273/207 |
| 2,152,381 | 3/1939 | Harpster | 273/186 R |
| 2,712,939 | 7/1955 | Harp | 273/207 X |
| 3,018,109 | 1/1962 | Starck | 273/186 R |
| 3,107,920 | 10/1963 | Strunk | 273/186 R |
| 3,350,101 | 10/1967 | Bishop et al. | 273/186 R |
| 3,406,977 | 10/1968 | Voelkerding | 273/202 |
| 3,414,267 | 12/1968 | Engle et al. | 273/186.1 |
| 3,429,577 | 2/1969 | Godden et al. | 273/186 R |
| 3,740,054 | 6/1973 | Arkin | 273/197 A |
| 3,790,176 | 2/1974 | Rietz | 273/186 R |
| 3,827,696 | 8/1974 | Schafer | 273/200 R X |
| 4,645,208 | 2/1987 | Morabeto | 273/207 |
| 4,786,057 | 11/1988 | Brown | 273/186 R |
| 4,905,999 | 3/1990 | Voinovich et al. | 273/32.5 |
| 4,913,440 | 4/1990 | Ellington | 273/186 R |
| 5,042,814 | 8/1991 | Bennett | 273/186 R X |

FOREIGN PATENT DOCUMENTS

| | | | |
|---|---|---|---|
| 383767 | 11/1932 | United Kingdom | 273/200 B |

*Primary Examiner*—George J. Marlo
*Attorney, Agent, or Firm*—Hill, Steadman & Simpson

[57] ABSTRACT

A pocket-sized golf backswing training device is provided having an elongated hinged tee which has a rod-like lower portion insertable into the ground. A ball is secured to a top of the hinged tee. The tee is movably retained in a predetermined upright position by a positioning means such as a cooperative engagement between upper and lower tee portions. In an embodiment, the upper and lower tee portions are pivotally hinged together by a pin extending through overlapping narrowed segments of the respective tee portions. The device is planted in the ground, positioning the ball in a desired backswing path of a golf club. A practicing golfer then swings the club rearwardly. When a proper backswing is executed, the ball is struck by the club head, tipping the device to a pivoted position. The pivoting of the tee indicates to the golfer that a proper backswing has been executed.

6 Claims, 1 Drawing Sheet

GOLF BACKSWING TRAINING DEVICE

BACKGROUND OF THE INVENTION

The present invention generally relates to a golf training device. More particularly, the present invention relates to a system and method for monitoring a golfer's backswing.

In golf, development of a proper golf swing is necessary to achieving an appreciable skill level. Like many athletic activities, a golf swing is improved through practice and training. A good golf swing is consistent when the golfer has developed an ability to move the club in a proper motion repeatedly.

A backswing is naturally an initial part of a golf swing. A golfer arcuately retracts a golf club head away from a golf ball as a "windup" for striking the ball forward. It is recognized that a properly directed and consistent backswing is an important part of a good overall golf swing. Accordingly, practice devices are known for monitoring both a backswing and a follow-through of a golf club in order to develop a consistent club motion.

For example, U.S. Pat. No. 4,786,057 relates to a golf training device having a flat, rectangular base platform on which a golf tee is forwardly mounted and on which a hinged flap is rearwardly mounted. The flap is positioned in a desired backswing path relative to the tee so that the flap is knocked from a vertical position to a horizontal position when a proper backswing is executed.

Also, U.S. Pat. No. 3,350,101 relates to a practice device having a base platform to which a golf tee is forwardly secured. A spool of wound yieldable strip material is secured to the pad rearwardly. A portion of the strip material is directed vertically upward in an adjustable manner within a proper backswing path.

U.S. Pat. No. 5,042,814 relates to an apparatus which measures backswing speed. The apparatus is a rectangular platform which includes a pair of detectors arranged behind a golf tee in a predetermined backswing path. When struck by a golf club during a backswing, each detector sends an electronic signal from which backswing speed is calculated.

U.S. Pat. No. 2,712,939 relates to another device for indicating a golf club swing path. The device includes a pivotable tee mounted centrally on a triangular base platform. A rearwardly mounted pivotable peg is provided, as well as a pair of forwardly side-mounted pivotable pegs relative to the tee. The forward pegs are positioned to indicate an improper hook or slice swing path. The rearward peg is positioned to be tipped over during a proper backswing.

Each of the backswing monitoring devices discussed above includes a large platform-like base structure. It is desirable to provide golf practice devices which are truly portable, preferably pocket-sized, so that a golfer can conveniently practice anywhere, without carrying cumbersome training equipment. Therefore, a need exists for a convenient and portable device for monitoring the consistency of a golfer's backswing.

SUMMARY OF THE INVENTION

The present invention provides a golf backswing training device which is pocket-sized and conveniently portable. To this end, the training device includes a hinged tee having a lower elongated tee portion with a tapered tip. This lower tee portion is insertable into the ground. The tapered tip allows easy insertion. The device also includes an upper tee portion pivotally secured to the lower tee portion. In an embodiment, the upper tee portion is pivotally secured to the lower tee portion by a hinge. A positioning means is also provided to hold the upper tee portion in a predetermined position relative to the lower tee portion. Preferably, the predetermined position is such that the upper tee portion and lower tee portion are aligned along a common axis. Furthermore, a ball is secured to the upper tee portion. In an embodiment, the tee portions can be made of plastic or wood.

The present invention also provides a method of practicing a golf backswing. The lower tee portion is inserted into the ground so that the ball is positioned in a desired backswing path relative to a golfer's stance. Then, the practicing golfer swings a golf club so that a head of the golf club strikes the ball during his backswing. This tips the upper tee portion relative to the lower tee portion to a tipped position away from the predetermined position. The tipping indicates to the practicing golfer that his or her backswing has been executed along the desired backswing path.

Therefore, an advantage of the present invention is to provide a golf backswing training device which is pocket-sized. A golfer can easily carry the device in his pocket or golf bag for convenient backswing practicing almost anywhere. This overcomes the inconvenience of storing and carrying a large, cumbersome conventional unit having a platform-type base.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figures 1, 2, 3, 4:
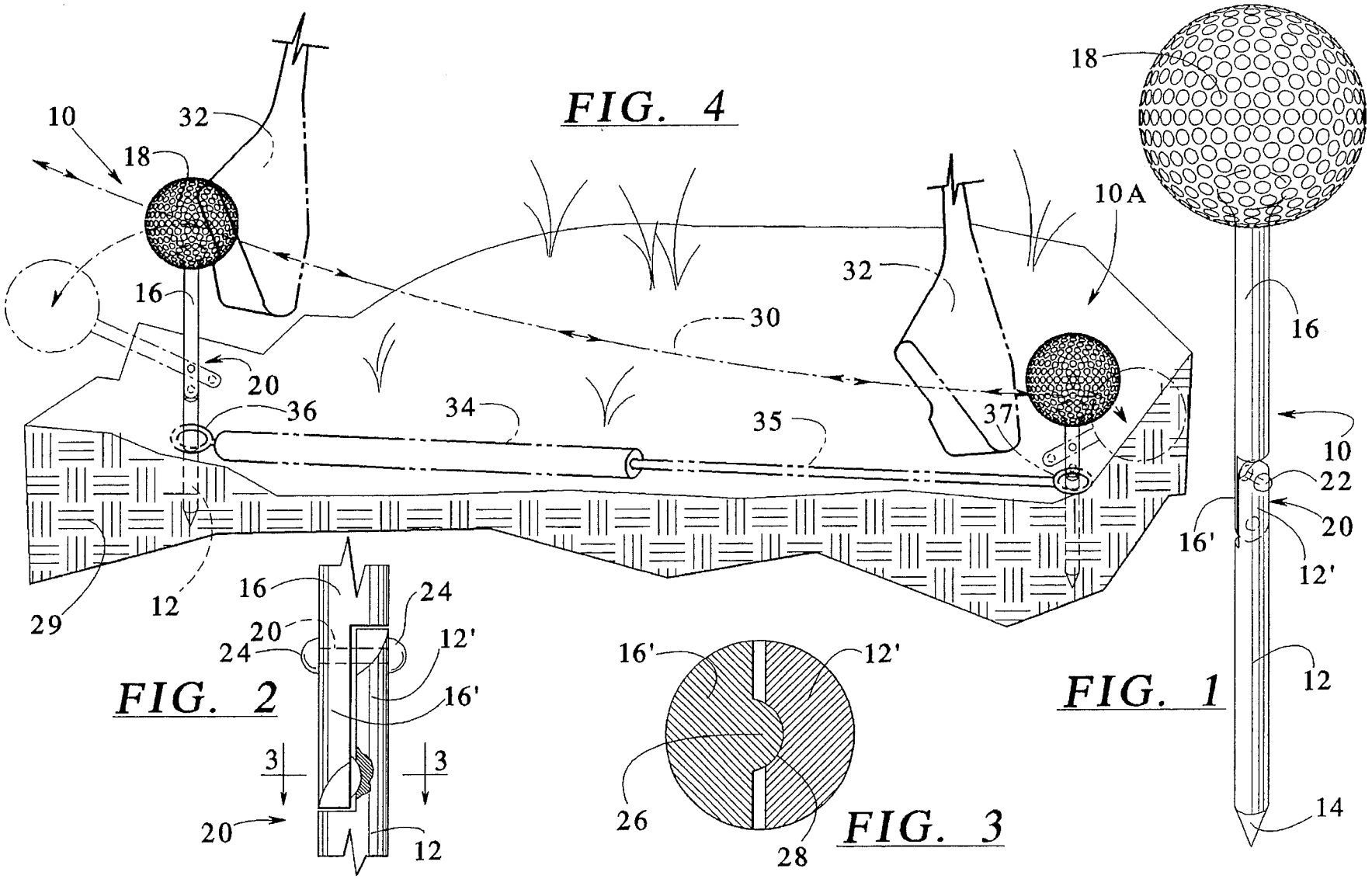
FIG. 1 illustrates a perspective view of a training device accordingly to the present invention.
FIG. 2 illustrates an enlarged fragmentary front plan view of a pivoting section of the device of FIG. 1.
FIG. 3 illustrates a sectional view taken generally along line III—III of FIG. 2.
FIG. 4 illustrates the device in use to monitor the desired backswing motion of a golf club.

FIG. 1 illustrates an embodiment of a training device 10 according to the present invention. The device 10 is pocket-sized to be conveniently portable. The device 10 includes a lower tee portion 12 having a tapered tip 14. The tapered tip 14 allows the lower tee portion 12 to be easily inserted into the ground (as shown in FIG. 4, discussed below). An upper tee portion 16 is pivotally secured to the lower tee portion 12. A ball 18 is secured to a top of the upper tee portion 16. In an embodiment, the ball 18 is made of hollow plastic, such as a practice golf ball. It should be recognized that the ball 18 need not be a conventional golf ball nor even resemble one.

The upper tee portion and lower tee portion are preferably elongated and rod-like. In an embodiment, the upper tee portion and lower tee portion are made of a durable plastic material. However, other suitable materials can also be used, such as wood. The upper tee portion and lower tee portion are secured together at a hinge 20. FIG. 2 illustrates the hinge 20 in detail. In the region of the hinge 20, the upper tee portion has a narrowed segment 16'. The lower tee portion 12 similarly has a narrowed portion 12' disposed vertically adjacent to the narrowed portion 16'. The narrowed portions 12' and 16' each are approximately one half the thickness or diameter of the tee. A pin 22 is disposed horizontally through the narrowed segments 12' and 16'. The pin 22 is rivet-like, having an enlarged head 24 at each end to hold the pin 22 in place.

The device includes a positioning means to movably hold the upper tee portion 16 in a straight, upright position relative to the lower tee portion 12, i.e., on a common axis with the lower tee portion 12. As illustrated in the embodiment of FIGS. 2 and 3, the upper and lower narrowed segments 12' and 16' engage each other in a locking manner in such a position wherein the upper and lower tee portions 12 and 16 are aligned on a common axis. A rounded projection 26 extending from the narrowed segment 16' of the upper tee portion 16 forms this cooperative engagement. A recess 28 is provided in the narrowed segment 12' of the lower tee portion 12 to cooperatively receive the rounded projection 26. The upper and lower narrowed segments 12' and 16' are slightly resilient, allowing the hinge 20 to pivot into and out of a predetermined set position defined by the locking engagement of the rounded projection 26 in the recess 28.

In a possible embodiment, the positioning means can be friction between the narrowed segments 12' and 16' due to a tight fitting of the pin 22. In such an embodiment, the projection 26 and recess 28 are not necessary.

Turning to FIG. 4, the lower tee portion 12 can be inserted into the ground 29 so that the hinge 20 is above ground. The device 10 is planted this way so that the ball 18 is positioned directly in a desired proper backswing path 30 (arrows) of a golf club 32. When a golfer executes a proper backswing, the golf club 32 strikes the ball 18, tipping the device 10 from an upright position to a pivoted or tipped position (shown in phantom lines). If the backswing is executed along an improper path, the golf club 32 will miss the device 10 entirely or fail to tip it over. The device 10 can be reset by simply moving the upper tee portion 16 to the upright position, engaging the rounded extension 26 in the recess 28.

Repeated execution of the backswing along the proper path 30 helps the golfer to develop a proper, consistent golf swing. The tipping or nontipping of the device 10 indicates to the golfer whether his backswing requires correction.

More than one device 10 can be used at one time by arranging multiple devices 10 within the backswing path 30. Accordingly, the device 10 can be made with several available upper or lower tee portion lengths, so that the devices 10 can be used at various selected points in the backswing arc at respective vertical heights.

In addition to positioning one or more devices 10 for backswing training, one device 10A can also be positioned in a normal ball position to receive contact from the club 32 on a forward follow-through. As illustrated in FIG. 4, a device 10A is placed in the normal tee position. The device 10A is shorter than the device 10 because it is desirably in a lower point of the swing path 30.

In an optional embodiment, the devices 10 and 10A can be secured to one another in order to fix their relative positions. For this purpose, two interlocking elongated members 34 and 35 are provided as a fixing member. The member 35 has an end ring 37, and the member 34 has a similar end ring 36. The ends 36 and 37 fit around the respective lower tee portions. In the embodiment shown, the members 34 and 35 are configured in a telescoping arrangement. The members 34 and 35 are thus preferably lockably moveable relative to each other in order to set a selected distance between the devices 10 and 10A, which varies depending on a golfer's height. Accordingly, in an embodiment, the elongated member 35 can have markings thereon to indicate various settings corresponding to the golfer's height. However, some other fixing means could be used to fix the distance between the devices 10 and 10A, such as a single-piece rigid element or even a string.

It should be understood that various changes and modifications will be apparent to those skilled in the art. Such changes and modifications can be made without departing from the spirit and scope of the present invention and without departing from its attendant advantages. It is, therefore, intended that such changes and modifications be covered by the appended claims.

What is claimed is:

1. A pocket-sized golf backswing training device consisting essentially of:

a rod-like lower tee portion at least partially insertable into the ground, the lower tee portion having a narrowed segment at one end;

a rod-like upper tee portion having a narrowed segment at one end;

a pin extending through the narrowed segments, pivotally securing the narrowed segments together in an overlapping manner;

a positioning means to movably hold the upper tee portion in a predetermined position relative to the lower tee portion; and a ball secured to the upper tee portion.

2. The golf backswing training device according to claim 1 wherein the ball is approximately the size of a golf ball.

3. The golf backswing training device according to claim 1 wherein the positioning means comprises:

a rounded projection extending from the narrowed segment of the upper tee portion; and a recess in the narrowed segment of the lower tee portion which cooperatively receives the rounded extension.

4. The device according to claim 1 wherein the lower tee portion and upper tee portion are made of a plastic material.

5. The device according to claim 1 wherein the lower tee portion and upper tee portion are made of a wood material.

6. The device according to claim 1, wherein the lower tee portion has a tapered tip opposite the narrowed segment.

* * * * *